US005661948A

United States Patent [19]

Odenthal

[11] Patent Number: 5,661,948

[45] Date of Patent: Sep. 2, 1997

[54] PACKAGING SYSTEM

[75] Inventor: Heinz F. Odenthal, Zülpich, Germany

[73] Assignee: Ostma Maschinenbau GmbH, Zulpich, Germany

[21] Appl. No.: 531,033

[22] Filed: Sep. 20, 1995

[30] Foreign Application Priority Data

Dec. 3, 1994 [DE] Germany ..... 44 43 110.4
Mar. 1, 1995 [DE] Germany ..... 29503391

[51] Int. Cl.[6] ..... B65B 61/20

[52] U.S. Cl. ..... 53/131.5; 53/135.1; 53/157; 53/52; 53/55; 53/238; 53/389.3; 53/564; 493/55; 493/320

[58] Field of Search ..... 493/1, 2, 3, 53, 493/54, 55, 320; 53/52, 55, 64, 66, 131.2, 131.4, 131.5, 135.1, 136.1, 564, 155, 157, 168, 237, 238, 240, 389.3, 411, 415, 445, 456, 474, 504, 558, 563

[56] References Cited

U.S. PATENT DOCUMENTS 1,964,122 6/1934 Johnson ..... 53/157 X
3,085,374 4/1963 Powell ..... 53/456 X
3,240,611 3/1966 Williams ..... 53/456
3,477,200 11/1969 Weinberger et al. ..... 53/474 X
3,650,773 3/1972 Bush et al. ..... 53/415 X
3,653,176 4/1972 Gess ..... 53/136.1 X
4,604,083 8/1986 Barny et al. ..... 493/55 X

*Primary Examiner*—Daniel Moon
*Attorney, Agent, or Firm*—Herbert Dubno; Andrew Wilford

[57] ABSTRACT

A packaging system has a conveyor, a coil of a web of box material, and a box-making unit adjacent the coil for pulling the box-material web from its coil, printing on the box-material web, cutting the printed box-material web into individual carton blanks, forming the blanks into individual upwardly open boxes, and depositing the boxes on the conveyor. A coil of label material is provided adjacent a label-making unit that pulls the label-material web from the coil, prints on the label-material web, cuts the printed label-material coil into individual labels, applies the labels to objects secured from a source of the objects, and loads respective pluralities of the labeled objects into respective ones of the open boxes on the conveyor. Another coil of insert material is provided adjacent an insert-making unit that pulls the insert-material web from its coil, prints on the insert-material web, cuts the printed insert-material coil into individual inserts, and puts the inserts into respective ones of the open boxes. The boxes are closed after insertion thereinto of the objects and inserts. A computer is connected to the box-, label-, and insert-making unit for synchronously operating same in accordance with a program.

1 Claim, 1 Drawing Sheet

PACKAGING SYSTEM

FIELD OF THE INVENTION

The present invention relates to a packaging system. More particularly this invention concerns a method of and apparatus for preparing ready-to-ship packages of vials or the like.

BACKGROUND OF THE INVENTION

In the marketing of small objects, such as vials, bottles, or the like filled with a liquid, pasty, or otherwise fluent material it is necessary to provide individual labels on the objects, then group them in lots, and load the lots into shipping boxes or cartons. These cartons in turn must be made up to the requisite size for the lot they are to hold and must be printed with indicia identifying the contents as well as the manufacturer or shipper and the person to whom the package is being sent. This type of packaging system is common in the cosmetic and pharmaceutical industry.

Normally these steps are done in separate production lines whose outputs are stored before the final package is assembled and completed. Thus labels are made up at one location and stored, then applied at another. Similarly boxes are made up at one location and printed at another. The labeled objects are typically stored in large quantities and then subdivided into lots that are loaded into the boxes. In general the procedure is complex and slow. Errors are common and the costs incurred in making up shippable packages are considerable.

OBJECTS OF THE INVENTION

It is therefore an object of the present invention to provide an improved packaging system.

Another object is the provision of such an improved packaging system which overcomes the above-given disadvantages, that is which can efficiently produce shippable packages with lots of individually labeled objects packed in individually printed custom cartons.

SUMMARY OF THE INVENTION

A packaging system has according to the invention a conveyor, a coil of a web of box material, and a box-making unit adjacent the coil for pulling the box-material web from its coil, printing on the box-material web, cutting the printed box-material web into individual carton blanks, forming the blanks into individual upwardly open boxes, and depositing the boxes on the conveyor. A coil of label material is provided adjacent a label-making unit that pulls the label-material web from the coil, prints on the label-material web, cuts the printed label-material coil into individual labels, applies the labels to objects secured from a source of the objects, and loads respective pluralities of the labeled objects into respective ones of the open boxes on the conveyor. Another coil of insert material is provided adjacent an insert-making unit that pulls the insert-material web from its coil, prints on the insert-material web, cuts the printed insert-material coil into individual inserts, and puts the inserts into respective ones of the open boxes. The boxes are closed after insertion thereinto of the objects and inserts. According to the invention a computer is connected to the box-, label-, and insert-making unit for synchronously operating same in accordance with a program.

Such a system is ideal for so-called "just in time" operations where the order is assembled and shipped at the last possible moment. The computer prints up custom labels that it applies to a predetermined number of the objects that it then loads into a custom-folded carton provided with a custom-made insert. The carton carries the specific to and from addresses as well, if desired, as content or stocking information.

The labeling device does not simply stick labels on the objects, but actually determines the size of the labels and prints them. The box-making machine similarly operates as described in German 4,411,473 to custom-manufacture boxes that are just the right size for the lot being packaged. The necessary content and address information is printed on the box before it is even loaded, eliminating the need for a printer that must work with a full box. Similarly the insert-making device prepares a package insert or inserts that are particularly intended for the package in question.

The invention is based on the recognition that it is possible to make a ready-to-ship package in a simple manner by using a computer to control the production of the labels, boxes, and inserts before they are brought together. This reduces the number of machines needed and makes each machine's job that much easier. For instance printing on the cardboard blank before the box is folded and erected is much easier than printing on a full box, and similarly printing up a custom label on a strip of label material is easier than selecting any of a plurality of preprinted labels. Such a system is ideal for just-in-time operation.

According to the invention the box-, label-, and insert-making unit each pull the respective web continuously from the respective coil. In addition each of the box-, label-, and insert-making unit includes a looper so that the respective printer and cutter can operate intermittently.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
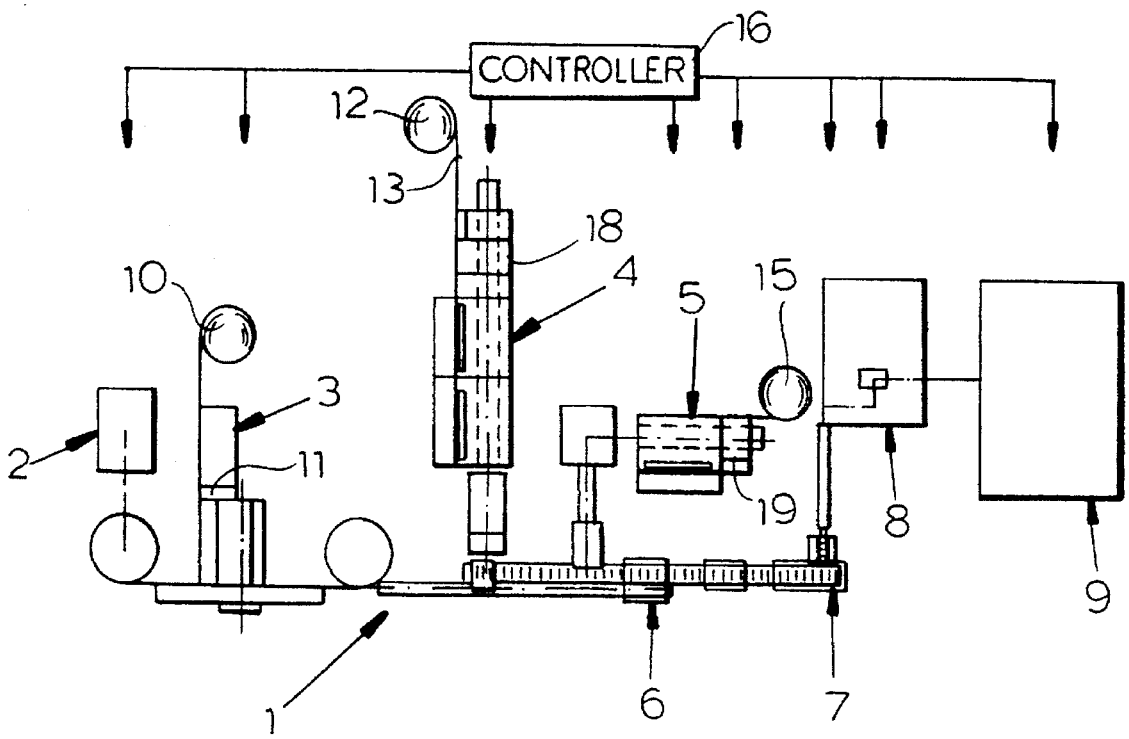
FIG. 1 is a small scale top schematic view of the system of this invention.
Figure 2:
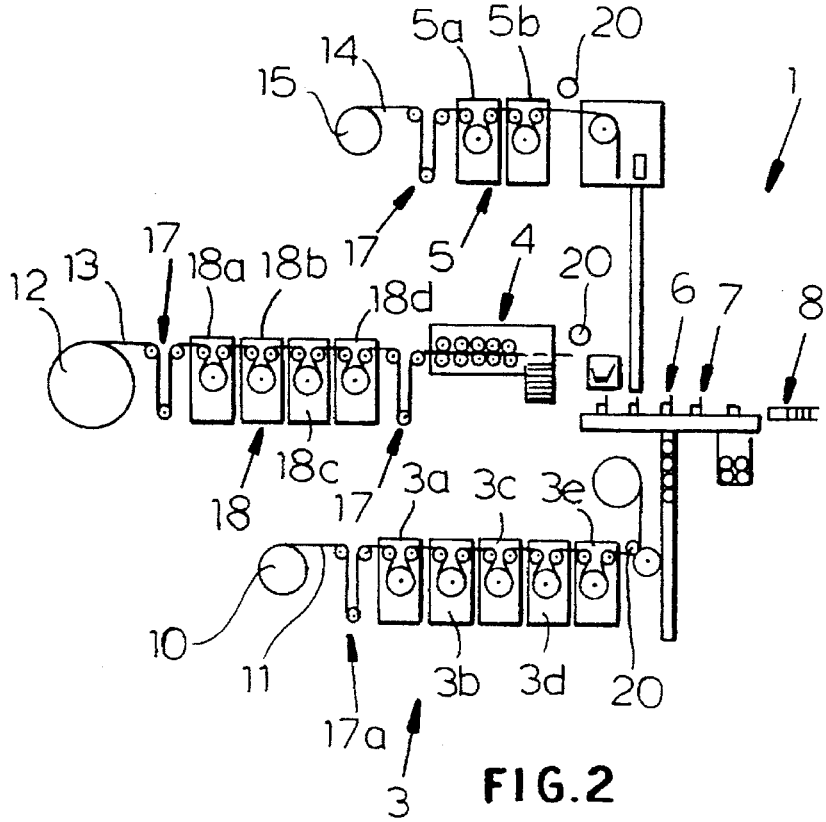
FIG. 2 is an end view of a detail of FIG. 1.

As seen in FIG. 1 a conveyor 1 has an upstream end at a supply 2 of vials and passes these vials through a labeling device 3, then loads them at a loading station 6 into cartons made in a folding device 4. A device 5 drops package inserts into the cartons upstream of the loading station 6. The conveyor 1 ends at a box-closing station 8 where they packages are grouped together at a packer 8 or a palletizer 9.

The labels are made from a label strip 10 that is printed, cut, and applied to the vials by a device 11. The boxes are made from a web 13 pulled from a coil 12, printed by a printer 18, and cut and folded by a box-making unit 4 before being deposited in open condition on the conveyor 1. The inserts are printed on paper 14 pulled from a roll 15 by a printer 19 and then deposited by the unit 5 in the open boxes, although it is of course possible to drop in the inserts after the vials are loaded in the boxes. All of these various printers and devices have sensors such as shown at 20 connected to a controller 16 that operates them in accordance with a program so that the appropriate labels can be put in the vials and the boxes can be printed with information regarding contents as well as to and from addresses. The finished package is in fact ready to ship.

With this system it is therefore possible for the machine, for instance, to make up one or more packages each holding a certain number of vials labeled in a certain way in a custom-fitted box labeled in a specific way and then, without any down time, to proceed with another group of packages that contain a different number of vials differently individually labeled in a differently sized carton that is differently labeled itself. Thus it is possible for a single production line to output a stream of packages that are of different sizes and differently labeled with differently labeled contents.

FIG. 3 shows how the printers 5, 3, and 18 are made up of respective printing stages 5*a*–5*b*, 3*a*–3*e*, and 18*a*–18*d* each preceded by a respective looper 17*a*, 17*b*, or 17*c* so that the respective paper webs 11, 13, and 14 can be payed out continuously and printed intermittently.

I claim:

1. A packaging system comprising:

a conveyor;

a coil of a web of box material;

box-making means adjacent the coil including a respective looper for continuously pulling the box-material web from its coil, intermittently printing on the box-material web, intermittently cutting the printed box-material web into individual carton blanks, forming the blanks into individual upwardly open boxes, and depositing the open boxes on the conveyor;

a supply of objects to be packaged;

a coil of label material;

label-making means adjacent the label-material coil including a respective looper for continuously pulling the label-material web from the coil, intermittently printing on the label-material web, intermittently cutting the printed label-material web into individual labels, applying the labels to the objects, separating the objects into lots, and loading the lots into respective ones of the open boxes on the conveyor;

a coil of insert material;

insert-making means adjacent the insert-material coil including a respective looper for continuously pulling the insert-material web from its coil, intermittently printing on the insert-material web, intermittently cutting the printed insert-material coil into individual inserts, and putting the inserts into respective ones of the open boxes;

means for closing the boxes after insertion thereinto of the lots of objects and the inserts; and computer means connected to the box-, label-, and insert-making means for synchronously operating same in accordance with a program.

* * * * *